US005769403A

United States Patent [19]

Tuttleman

[11] Patent Number: 5,769,403

[45] Date of Patent: Jun. 23, 1998

[54] PRINTING FORM

[76] Inventor: Eric S. Tuttleman, 5262 Potomac Run East, West Bloomfield, Mich. 48322

[21] Appl. No.: 717,480

[22] Filed: Sep. 20, 1996

Related U.S. Application Data

[60] Provisional application No. 60/004,101 Sep. 21, 1995.

[51] Int. Cl.[6] ..... B41F 13/54; B65H 39/02; B42D 15/00

[52] U.S. Cl. ..... 270/1.02; 270/58.07; 283/100; 283/103; 283/105

[58] Field of Search ..... 270/58.07, 1.02; 283/81, 2, 5, 100, 101, 103, 105, 57, 58, 59, 61, 66.1

[56] References Cited

U.S. PATENT DOCUMENTS

| | | | |
|---|---|---|---|
| 1,146,647 | 7/1915 | Mountz | 283/5 |
| 1,985,677 | 12/1934 | Hand | 283/5 |
| 4,637,635 | 1/1987 | Levine | 283/105 X |
| 5,085,417 | 2/1992 | Copham | 270/1.02 |
| 5,203,851 | 4/1993 | Browning et al. | 283/105 X |
| 5,299,834 | 4/1994 | Kraige | 283/81 X |
| 5,348,780 | 9/1994 | Boggs et al. | 283/105 X |
| 5,571,587 | 11/1996 | Bishop et al. | 283/105 X |

*Primary Examiner*—Hoang Nguyen
*Attorney, Agent, or Firm*—Arnold S. Weintraub

[57] ABSTRACT

A payment coupon is prepared by stacking a plurality of individual sheets of paper atop one another and then slitting or cutting the stacked array into a plurality of segments. Each individual sheet has a plurality of spaced apart perforation lines such that there is provided a first area, a second area, a third area, a fourth area and a fifth area. The first area defines a first binding area,; the second area defines a payment portion,; a portion of the third area defines a mailing label and the other portion of the third area defines a second binding area; the fourth area defines a payment portion; and the fifth area defines a mailing label area. Each sheet is cut into at least four segments, and preferably, eight segments. When the segments are stacked and bound along their respective edges, they provide payment coupon books whereby each coupon has its own mailing label associated therewith which can be separated from the sheet along a perforation line.

8 Claims, 1 Drawing Sheet

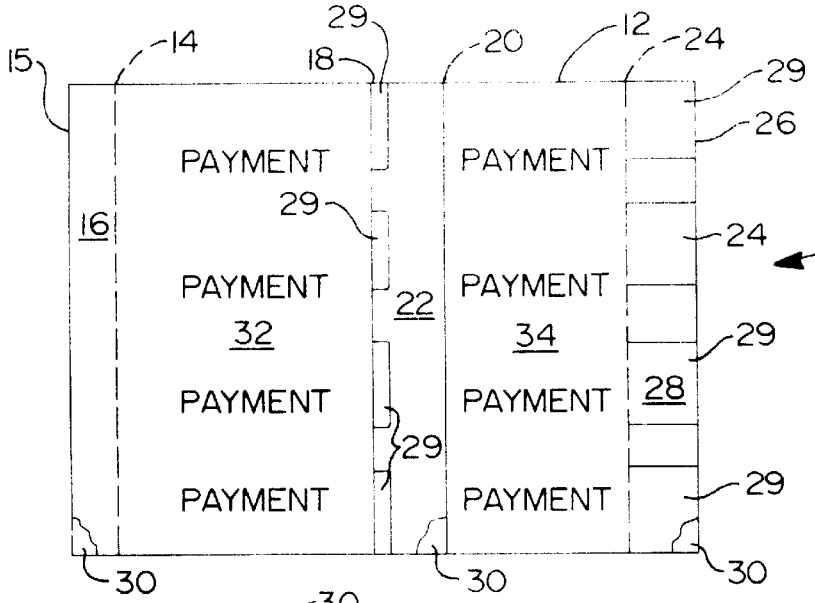
FIG 1
FIG 2
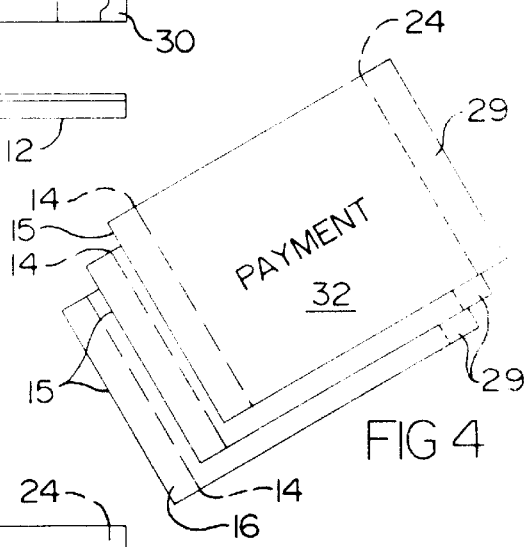
FIG 4
FIG 3
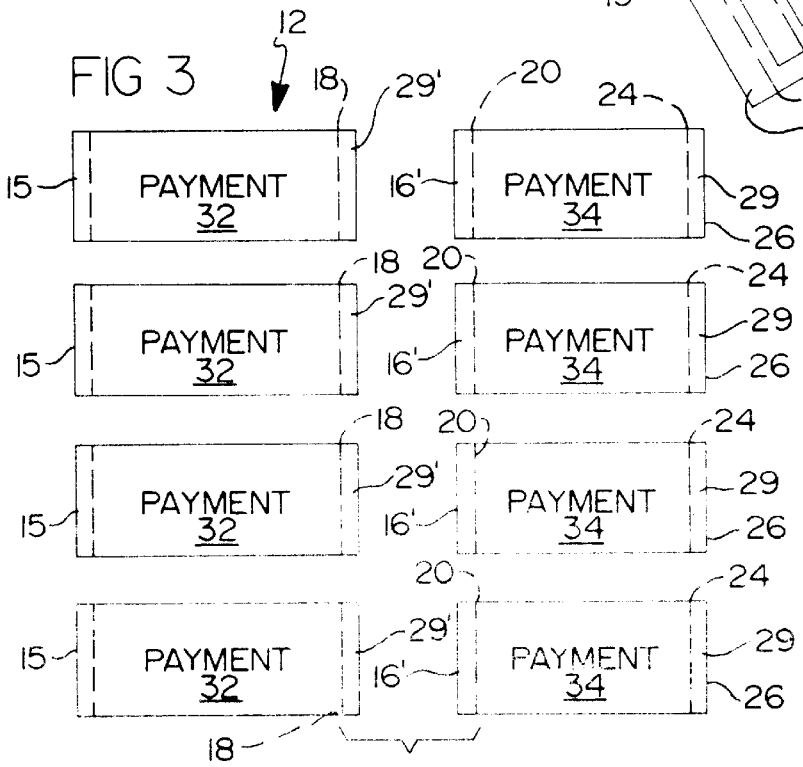

PRINTING FORM

CROSS REFERENCE TO RELATED APPLICATION

This application is the patent application emanating from co-pending U.S. provisional patent application No. 60/004,101, filed on Sep. 21, 1995 entitled "Printing Form", the disclosure of which is hereby incorporated by reference.

BACKGROUND OF THE INVENTION

1. Field of the Invention

The present invention pertains to articles of paper. More particularly, the present invention pertains to paper articles comprising separable sheets. Even more particularly, the present invention pertains to articles of paper comprising separable sheets and methods of manufacture therefor.

2. Prior Art

As is known to those skilled in the art to which the present invention pertains, a typical coupon payment book comprises a plurality of stacked or arrayed pieces of paper stock called "coupons". The coupons in the stacked array each have one end thereof bound together to the other coupons either by gluing, stitching or the like to form the "book". A portion of each coupon is perforated to enable easy separation of the coupon from the bound portion thereof.

However, in manufacturing such coupon books, often times, the paper stock becomes bound up in the feeding machines because of the uneven weight distribution accorded individual sheets of paper by the disposition of glue or the like at the binding or bound end thereof.

Moreover, in using payment coupon books the user, ordinarily, emplaces the coupon in a envelope which then has to be individually addressed. At times, separate mailing labels may be provided to the user or the remittance envelope must be hand addressed. It is evident that it would much more practical if there is provided a combined coupon and mailing label.

As is subsequently detailed, the present invention addresses both the concerns of (a) the binding up of the sheets of paper during the processing thereof, and (b) providing a combined coupon and mailing label.

SUMMARY OF THE INVENTION

In accordance with the present invention, there is provided an article of paper which, generally, comprises:

(a) a sheet of stock paper having an upper surface and a lower surface, and being substantially rectangular, the sheet having a first edge and a second edge spaced apart from and parallel to the first edge;

(b) a first perforation line parallel to the first edge; and spaced inwardly therefrom, the area of the sheet therebetween defining a first area;

(c) a second perforation line parallel to the first perforation line and spaced therefrom toward the second edge, the space between the first perforation line and the second line of perforation defining a second area therebetween;

(d) a third perforation line parallel to the second perforation line and spaced therefrom toward the second edge, the space between the second perforation line and the third perforation line defining a third area therebetween;

(e) a fourth perforation line parallel to the third perforation line and spaced therefrom toward the second edge, the area between the third perforation line and the fourth perforation line defining a fourth area therebetween; and (f) the fourth perforation line being spaced from the second edge of the sheet, the area between the second edge and the fourth perforation line defining a fifth area there between; and (g) a quantity of adhesive deposited solely on the lower surface of the first, third, and fouth areas.

In forming a coupon book, a plurality of such stock sheets are stacked, one atop the other, such that all of the first edges are aligned. In this manner, the first area of each sheet becomes a binding area for a payment coupon book derived therefrom.

An adhesive is deposited on the lower surface of each of the sheets in their, respective, first areas, as well as the third and fifth areas, to facilitate the binding together of the sheets at the first edges in the first areas as well as to evenly distribute the weight of the sheet to minimize mis-feeding. Alternatively, the stacked sheets may be stitched or otherwise secured one to the other in overlying relationship in the first area.

A portion of the third area and the fifth area have suitable indicia emplaced thereon so that these areas define mailing labels.

The adhesive of each sheet associated with the mailing label portions may be wetted to facilitate adherence to an envelope.

For a more complete understanding of the present invention reference is made to the following detailed description and accompanying drawing. In the drawing like reference characters refer to like parts throughout the several view in which:

BRIEF DESCRIPTION OF THE DRAWINGS

FIG. 1 is a first elevational view of a printing form in accordance with the present invention;

FIG. 2 is a rear elevational view of a printing form in accordance with the present invention;

FIG. 3 is a plan view of a slitted sheet of stock expanded and separated; and FIG. 4 is an exploded, perspective view of a coupon book derived from the segments of FIG. 3.

DESCRIPTION OF THE PREFERRED EMBODIMENT

With reference to the drawing there is depicted therein a printing form prepared from paper stock and, generally, denoted at 10. In a particularly preferred embodiment hereof the paper stock is used to prepare what is typically referred to as a "payment coupon" book (FIG. 4).

In accordance herewith and as discussed below the paper stock 10 used in preparing coupons therefrom comprises a sheet of paper 12 of pre-selected and weight.

The paper 12 has a first perforation line 14 provided therealong proximate a first edge or end 15 thereof, as shown. An area 16 is defined between the edge 15 of the paper 12 and the perforation line 14. The area 16 between the end 15 of the sheet 12 and the first perforation line 14 is, optimally, that end of the sheet 12 which is used as the bound end.

As shown, a pair of spaced apart, substantially parallel perforations 18 and 20 are formed along the extent of the paper 12, as shown. The perforations 18 and 20 are parallel to the perforation 14. The space between the two perforations 18 and 20 defines an area 22.

A fourth perforation 24 is provided and formed parallel to the perforations 14, 18 and 20. The perforation 24 is formed proximate the edge or end 26 of the paper 12. The edge 26 is parallel to and spaced apart from the edge 15, as shown.

The space between the edge 26 and the perforation line 24 defines an area 28.

Similarly, the space between perforation line 14 and perforation line 18 defines an area 32 and the space between perforation line 20 and line 24 defines an area 34. The areas 32 and 34 have repetitive indicia printed thereon, as shown, which define the "payment" portion of the coupon.

Heretofore in manufacturing a form 10 from the paper 12 an adhesive, such as a gum adhesive 30 was emplaced on the lower surface of the sheet 12, in the areas 22 and 28, but not in the area 16. However, in feeding the stock through a slitter or the like, absent a glue or other adhesive in the area 16 the stock becomes bound up in the slitter leading to misfeeds and the like. Therefore, in order to balance the weight of the stock, an adhesive, such as the gum-type glue 30 is deposited on the lower surface of the sheet 12 in the area 16, as well as on the lower surface in the areas 22 and 28. Thus, an even weight, is accorded the stock, obviating feeding problems.

The adhesive is, preferably, a wettable adhesive which can be adhered to a mailing envelope or the like (not shown).

Each piece of paper 12 is used to form a plurality of payment coupons. As shown in FIGS. 1, 3 and 4, the area 28 is used to form mailing labels by repetitive printing of mailing indicia 29 evenly spaced therealong. A portion of the area 22 functions to define a plurality of mailing labels 29' in the same way. The mailing labels 29 and 29' are separable from the book along their associated perforation lines 24 and 18.

In use, and as shown in FIG. 3, and after perforation and depositing of the glue 30 in the areas 16, 22 and 28 the sheet 12 is slit both horizontally and vertically into a plurality of segments. Horizontal splitting divides the paper into a plurality of elongated strips. The vertical slit divides the medial area 22 into the mailing label portions 29' and a binding end portion 16' having an area similar to that of area 16. Thus, in a preferred embodiment hereof the sheet 12 is subdivided into eight (8) coupons each being similarly constructed.

In assembling a payment coupon book in accordance herewith a plurality of coupons are stacked atop each other and bound together with the mailing label end being disposed at the free end of the coupon. The perforation 14 enables separation of an individual coupon from the remainder of the book, while the perforations 18 and 24 enable separation of their mailing labels from the payment portion.

By providing the glue strip 30 in the area 16 there is accorded not only even weight distribution to the paper stock, but also a more readily convenient way of binding the books together.

Having, thus, described the invention, what is claimed is:

1.An article of paper which, generally, comprises:

(a) a sheet of stock of substantially rectangular configuration, having an upper surface and a lower surface, the sheet having a first edge and a second edge, the second edge being spaced apart from and parallel to the first edge;

(b) a first perforation line parallel and proximate to the first edge and having a space therebetween, the space between the first perforation line and the first edge defining a first area therebetween;

(c) a second perforation line parallel to the first perforation line and spaced therefrom toward the second edge, the space between the first perforation line and the second perforation line defining a second area therebetween;

(d) a third perforation line parallel to the second perforation line and spaced therefrom toward the second edge, the space between the second perforation line and the third perforation line defining a third area therebetween;

(e) a fourth perforation line parallel to the third perforation line and spaced therefrom toward the second edge, the space between the third perforation line and the fourth perforation line defining a fourth area therebetween;

(f) the fourth perforation line being spaced from the second edge of the sheet, the space between the second edge and the fourth perforation line defining a fifth area therebetween; and (g) a quantity of adhesive deposited solely on the second surface of the first, third, and fifth areas.

2. A method of manufacturing a payment coupon book, which comprises:

(a) providing a plurality of sheets of paper in overlying stacked relationship, each sheet comprising the sheet of claim 1;

(b) slitting the plurality of stacked sheets in a first direction normal to the first edge and second edge;

(c) slitting the plurality of sheets in the third area in a direction parallel to the second and third perforations to divide each sheet into segments, each stack of segments defining a book; and (d) thereafter, binding the respective first edges of each of the stacks together.

3. The method of claim 2 which further comprises emplacing printed indicia in the respective fifth areas of each of the individual segments, the fifth area of each individual segment defining a mailing label separable from the segment along its portion of the fourth perforation line.

4. The method of claim 2 wherein each individual sheet is slit into eight individual segments, each segment having a portion thereof defining a mailing label.

5. A method of manufacturing a payment coupon book, which comprises:

(a) providing a plurality of sheets of paper in overlying stacked relationship, each sheet comprising:

(1) a sheet of stock of substantially rectangular configuration, having an upper surface and a lower surface, the sheet having a first edge and a second edge, the second edge being spaced apart from and parallel to the first edge;

(2) a first perforation line parallel and proximate to the first edge and having a space therebetween, the space between the first perforation line and the first edge defining a first area therebetween;

(3) a second perforation line parallel to the first perforation line and spaced therefrom toward the second edge, the space between the first perforation line and the second perforation line defining a second area therebetween;

(4) a third perforation line parallel to the second perforation line and spaced therefrom toward the second edge, the space between the second perforation line and the third perforation line defining a third area therebetween;

(5) a fourth perforation line parallel to the third perforation line and spaced therefrom toward the second edge, the space between the third perforation line and the fourth perforation line defining a fourth area therebetween;

(6) the fourth perforation line being spaced from the second edge of the sheet, the space between the second edge and the fourth perforation line defining a fifth area therebetween;

(b) slitting the plurality of stacked sheets in a first direction normal to the first edge and the second edge;

(c) slitting the plurality of sheets in the third area in a direction parallel to the second and third perforations to divide each sheet into segments, each stack of segments defining a book; and (d) thereafter, binding the respective first edges of each of the stacks together.

6. The method of claim 5 which further comprises emplacing printed indicia in the respective fifth areas of each of the individual segments, the fifth area of each individual segment defining a mailing label separable from the segment along its portion of the fourth perforation line.

7. The method of claim 5 wherein each individual sheet is slit into eight individual segments, each segment having a portion thereof defining a mailing label.

8. The method of claim 5 which further comprises: depositing a quantity of adhesive solely on the lower surface of the first, third, and fifth areas.

* * * * *